US009291346B2

(12) United States Patent
Lenoir et al.

(10) Patent No.: US 9,291,346 B2
(45) Date of Patent: Mar. 22, 2016

(54) GAS FIRED RADIATION EMITTER WITH EMBOSSED SCREEN

(75) Inventors: Patrick Lenoir, Villeneuve d'Ascq (FR); Valérie Olalde, Lille (FR); Nicolas Even, Houplines (FR)

(73) Assignee: SOLARONICS S.A., Armentières (FR)

( * ) Notice: Subject to any disclaimer, the term of this patent is extended or adjusted under 35 U.S.C. 154(b) by 219 days.

(21) Appl. No.: 13/995,361

(22) PCT Filed: Dec. 12, 2011

(86) PCT No.: PCT/EP2011/072397

§ 371 (c)(1),
(2), (4) Date: Jun. 18, 2013

(87) PCT Pub. No.: WO2012/084561

PCT Pub. Date: Jun. 28, 2012

(65) Prior Publication Data

US 2013/0273485 A1 Oct. 17, 2013

(30) Foreign Application Priority Data

Dec. 20, 2010 (EP) ..... 10290667

(51) Int. Cl.
*F23D 14/14* (2006.01)
*F23D 14/16* (2006.01)

(52) U.S. Cl.
CPC ..... *F23D 14/145* (2013.01); *F23D 14/14* (2013.01); *F23D 14/16* (2013.01); *F23D 2203/103* (2013.01); *F23D 2203/105* (2013.01); *F23D 2900/14123* (2013.01); *F23D 2900/14125* (2013.01)

(58) Field of Classification Search
CPC ..... F23D 14/14; F23D 14/145; F23D 14/16
USPC ..... 431/329, 328, 326; 126/92 AC
See application file for complete search history.

(56) References Cited

U.S. PATENT DOCUMENTS

| | | | | |
|---|---|---|---|---|
| 3,122,197 | A | 2/1964 | Saponara et al. | |
| 3,439,996 | A | 4/1969 | Lherault et al. | |
| 3,885,907 | A * | 5/1975 | Teague, Jr. | F23D 14/14 431/328 |
| 4,597,734 | A * | 7/1986 | McCausland et al. | 431/328 |
| 4,799,879 | A | 1/1989 | Laspeyres | |

(Continued)

FOREIGN PATENT DOCUMENTS

| | | |
|---|---|---|
| BE | 1 007 596 A3 | 8/1995 |
| EP | 0 539 278 A1 | 4/1993 |

(Continued)

OTHER PUBLICATIONS

BE1007596A3 of Losfeld R et al, English machine translation, Aug. 1995.*

*Primary Examiner* — Gregory Huson
*Assistant Examiner* — Nikhil Mashruwala
(74) *Attorney, Agent, or Firm* — Foley & Lardner LLP

(57) ABSTRACT

The present invention relates to a gas fired infrared radiation emitter comprising a burner plate (140) acting as combustion surface and a radiant screen (160) positioned at the combustion side of the perforated tiles. The radiant screen is embossed (180) proving locally different distances between the burner plate and the radiant screen. The result is a higher performance of the gas fired infrared radiation emitter.

13 Claims, 5 Drawing Sheets

(56) References Cited

U.S. PATENT DOCUMENTS

| | | | | |
|---|---|---|---|---|
| 5,511,974 | A | 4/1996 | Gordon et al. | |
| 5,820,361 | A | 10/1998 | Lavigne et al. | |
| 5,989,013 | A | 11/1999 | Gray | |
| 6,514,071 | B1 | 2/2003 | Meyer | |
| 2001/0036610 | A1 | 11/2001 | Wood | |
| 2003/0054313 | A1* | 3/2003 | Rattner | F23D 14/16 431/326 |
| 2006/0003279 | A1* | 1/2006 | Best | A23L 1/0128 431/328 |
| 2006/0251998 | A1 | 11/2006 | Lamberts et al. | |
| 2009/0202688 | A1* | 8/2009 | Best | A47J 37/0682 426/240 |
| 2011/0117509 | A1* | 5/2011 | Claerbout | F23D 14/14 431/328 |

FOREIGN PATENT DOCUMENTS

| | | | | |
|---|---|---|---|---|
| GB | 953 568 | A | 3/1964 | |
| GB | 1 433 771 | A | 4/1976 | |
| WO | WO9318342 | * | 9/1993 | F23D 14/14 |

* cited by examiner

GAS FIRED RADIATION EMITTER WITH EMBOSSED SCREEN

TECHNICAL FIELD

The invention relates to the technical field of gas fired radiation emitters having a combustion surface and a radiation screen (or radiant screen) positioned in front of the combustion surface.

BACKGROUND ART

Gas fired infrared radiation emitters are widely used in the pulp and paper industry for the drying of coatings on moving cellulosic webs. These emitters are well known; thus, for example, one such emitter is described in U.S. Pat. No. 5,820,361.

The prior art gas fired infrared radiation emitters often contain a radiating (reverberating, radiant) screen (or "grating") which increases the radiant power output of the emitter while simultaneously protecting the primary radiating surface from contamination. An example of an emitter with a removable grating is disclosed in U.S. Pat. No. 5,820,361.

Radiant burners comprising a radiant burner plate and a screen are also known from e.g. U.S. Pat. No. 4,799,879 or EP0539278.

It is known in the field to use a reinforcing cross above the radiant screen in or to strengthen the radiant screen and increase its lifetime.

U.S. Pat. No. 6,514,071 describes a gas-fired infrared radiation emitter comprising a burner surface; a radiant screen and a frame structure on the screen to removably position and to strengthen the screen.

U.S. Pat. No. 5,989,013 describes a porous mat gas fired radiant burner panels utilizing improved reverberating screens. The purpose of these screens is to boost the overall radiant output of the burner relative to a burner using no screen and the same fuel-air flow rates. In one embodiment, the reverberating screen is fabricated from ceramic composite material, which can withstand higher operating temperatures than its metallic equivalent. In another embodiment of U.S. Pat. No. 5,989,013 the reverberating screen is corrugated. The corrugations add stiffness which helps to resist creep and thermally induced distortions due to temperature or thermal expansion coefficient differences. As an added benefit, it has been discovered that the corrugations further increase the radiant efficiency of the burner. In a preferred embodiment, the reverberating screen is both corrugated and made from ceramic composite material.

U.S. Pat. No. 3,122,197 discloses a radiant burner comprising a casting defining a cavity, one side of the casting having an opening formed therein, the remaining surface of the side defining a flat rim surrounding the opening, a venture tube connected, in fluid flow relation, to the interior of said cavity to convey gas and air thereto. A first flat, perforated member covering said opening, a second, flexible, perforated, combustion-sustaining member including a central portion which overlies the opening and the corresponding portion of the first member. The central portion is fabricated to provide a number of parallel, U-shaped formations which cover said opening. The biggest portion of some of the U-shaped formations having substantially line contact with the first member. The bight portions of the remaining U-shaped formations of the central portion are tangent to a plane spaced from, and parallel to, the plan of the first member. The distance between the planes is greater than the combined thickness of the first and second members. The disclosure includes means for detachably clamping the peripheries of both of the screens to the rim.

It has been common practice in radiant gas burners to join together a number of perforated tiles (e.g. perforated ceramic tiles) arranged in rows or a square to provide a unitary burner plate. Flexible joints between individual perforated tiles are known as well as rigid joints.

U.S. Pat. No. 3,439,996 for instance, relates to radiant gas burners constituted of assembled heat-insulating perforated refractory tiles or blocks. The tiles are joined side by side with a refractory jointing compound or tile cement which, upon hardening, bonds the tile together and holds them in assembled relationship much as bricks are bonded together by mortar.

A known problem of radiant gas burners relates to the efficiency and effectiveness of the radiant screens.

DISCLOSURE OF THE INVENTION

It is an objective of the invention to improve the performance of gas fired radiation emitters.

An aspect of the invention provides a gas fired infrared radiation emitter comprising a burner plate which is acting as combustion surface; and a radiant screen positioned at the combustion side of the burner plate. The radiant screen is embossed providing at the embossment different distances between the burner plate and the radiant screen compared to the distance between the burner plate and the radiant screen at the non-embossed part of the radiant screen.

With embossment is meant a deformation of a surface out of the plane along more than one linear direction in the plane. An embossment differs from an undulation in that in an undulation the deformation of a surface out of the plane is only along one linear direction in the plane, e.g. in the form of waves.

It is a benefit of the invention that the embossment or embossments present in the radiant screen increase the mechanical resistance of the screen, e.g. against the thermal deformations. Therefore, it allows the economy of a rigidifying means such as a metal cross.

Preferably, the burner plate which acts as combustion surface is comprising a ceramic plate or ceramic plates, e.g. a perforated ceramic tile or tiles.

In specific embodiments, the different distances at some of the embossments are closer distances. In further specific embodiments, the different distances at all of the embossments are closer distances.

In other specific embodiments, the different distances at at least some of the embossments are larger distances. Preferably, the embossments that have larger differences are positioned above locations of the burner plate that have higher temperatures than other zones, e.g. in the middle of the burner plate, or in the middle of tiles that are comprised in the burner plate. This has the benefit that the local higher temperature of the burner plate is compensated, resulting in more even temperature over the surface of the radiant screen and in a longer lifetime of the radiant screen.

In another embodiment of the invention, the burner plate comprises one perforated tile as combustion surface. An alternative aspect of the invention provides a gas fired infrared radiation emitter in which the burner plate comprises at least two perforated tiles. The perforated tiles are placed next to each other in one or two directions to form the burner plate.

In yet another embodiment, the radiant screen is embossed at at least one junction between two perforated tiles of the burner plate. In a more specific embodiment the embossment at at least one junction between two perforated tiles of the burner plate has closer distances, which presents an additional benefit. In burners according to the state of the art the junction between two perforated tiles is the coldest point of the burner plate; as a consequence, the part of the radiant screen located above this junction is at a lower temperature than the average temperature of the radiant screen, resulting in less infrared radiation energy emitted by the radiant screen. The embossment or embossments according to this more specific embodiment of the invention reduce locally the distance between the radiant screen and the burner plate. At these embossments, the radiant screen receives more convective heat resulting in a higher temperature and more infrared radiation energy sent out. The radiant screen radiates also energy back to the burner plate, relatively more energy is radiated back to the burner surface at the closer distance between burner surface and the screen. The burner surface temperature rises locally. Thus, the radiation energy is more uniform over the surface of the gas fired infrared radiation burner and the efficiency of the gas fired infrared radiation burner is increased.

The presence of the embossment or embossments at the perforated tile junctions with closer distances as in the specific embodiment has an additional benefit. The closer distance between embossment and the combustion surface does not lead to a higher temperature of the radiant screen as would be the case with undulations or embossments having closer distances above the combustion surface itself; which would lead to a higher thermal load at the embossments or undulations of the radiant screen due to the close position of the screen to the combustion surface.

In yet another embodiment, the radiant screen is embossed at all the junctions between perforated tiles of the burner plate.

In yet another embodiment, the burner plate comprises two perforated tiles positioned side by side, and the radiant screen is embossed at the junction between the two perforated tiles.

In one embodiment of the invention, the radiant screen is a metal grid.

In yet another embodiment of the invention, the radiant screen is a woven wire mesh.

In one embodiment, the different perforations—and hence the combustion spots—in the burner plate are all in the same plane. In another embodiment, the burner plate has multiple levels of combustion surface spread over the surface of the burner plate. This embodiment provides the further advantage that noise levels of the gas fired radiation emitter are reduced. In a preferred embodiment, the burner plate has two levels of combustion surface. In an even more preferred embodiment, the different levels of combustion surface are evenly distributed over the burner plate.

In one embodiment of the invention, a cross section of the embossment has a V—shape. In yet another embodiment of the invention, a cross section of the embossment has a U—shape.

In another embodiment of the invention, the radiant screen is (in addition to the screen being embossed) bent at at least one of the end sides of the radiant screen. It is a benefit of this embodiment that an additional rigidifying effect of the radiant screen is obtained.

In one embodiment of the invention there is an air gap between burner plate and radiant screen over the full surface of the burner plate.

Another aspect of the invention is the use of the gas fired radiation emitter according to the invention.

In a preferred embodiment, the radiant screen is fabricated from highly heat and corrosion resistant steel grades, such as high level stainless steel grades such as FeCrAl or FeCrAlMo alloy steel grades, or such as chrome/nickel steel grades (e.g. X10CrNiSiN21-11, X9CrNiSiNCe21-11-2 or X6CrNiSiNCe19-10; steel compositions according to EN-standards).

Alternatively, the radiant screen is produced from highly heat resistant materials such as ceramics, especially aluminum or zirconium oxide, aluminum titanate, silicon oxide, corundum or mullite, silicon carbide, silicon nitride or metal infiltrated ceramics, such as silicon-infiltrated silicon carbide. Alternatively, the radiant screen can also be fabricated from heat-resistant materials of other nature such as e.g. materials which contain more than 50% by weight of a metal silicide, such as molybdenum disilicide ($MoSi_2$) or tungsten disilicide ($WSi_2$).

In a preferred embodiment, the radiant burner plate comprises perforated tiles of a ceramic material with high temperature resistance, and excellent mechanical and thermodynamic properties such as e.g. cordierite or zirconia; partially stabilized zirconia (PSZ), alumina, silicon carbides or other high level technical ceramics.

BRIEF DESCRIPTION OF FIGURES IN THE DRAWINGS

Example embodiments of the invention are described hereinafter with reference to the accompanying drawings wherein FIG. 1 shows a schematic representation of a gas fired infrared radiation emitter according to the invention.

MODE(S) FOR CARRYING OUT THE INVENTION

Figure 1:
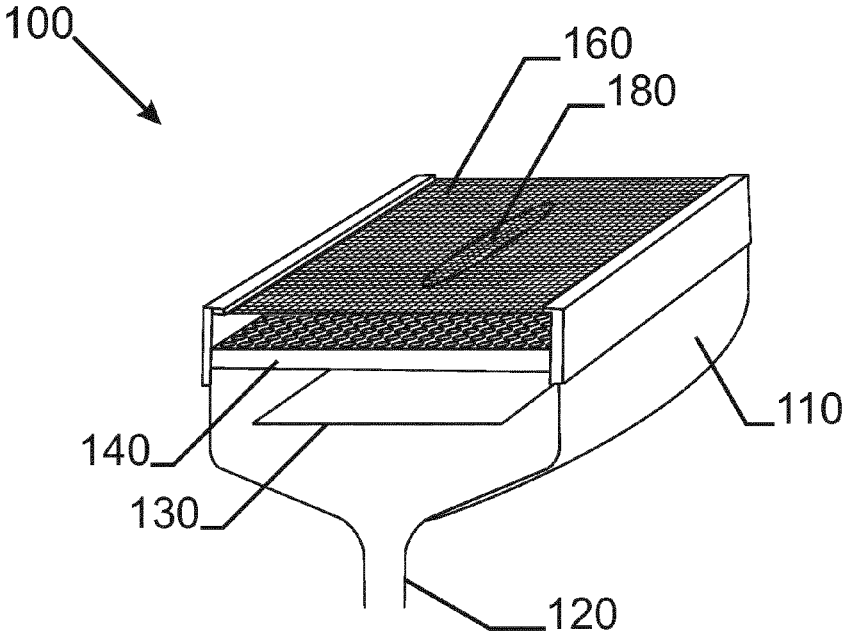

In an exemplary embodiment a gas fired radiation emitter 100 in FIG. 1 comprises a body 110, an inlet 120 for gas and air and a gas distribution plate 130 and burner plate 140. Radiant screen 160 has an embossment 180.

Figure 2:
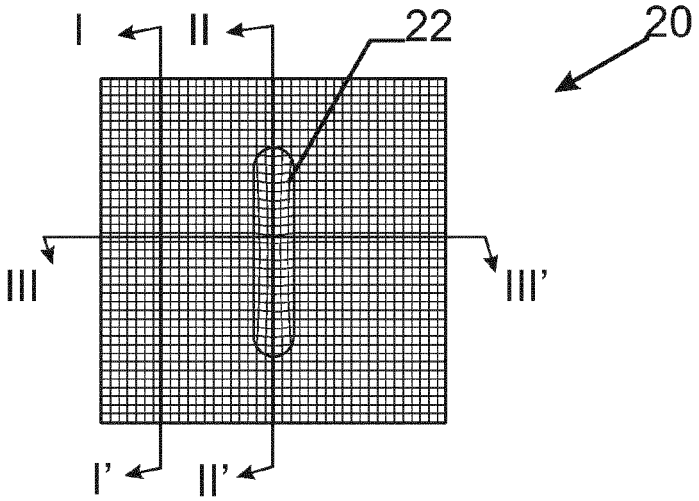
FIG. 2 shows a schematic representation of an example of embossment in the radiant screen.

FIG. 2 shows a top view of a radiant screen 20 with embossment 22 according to the invention.

Figure 3:
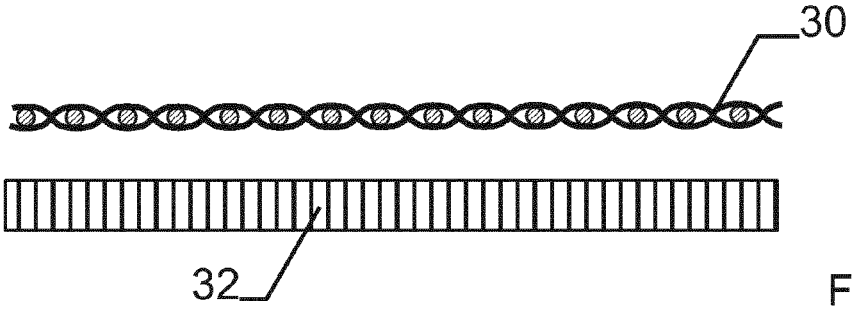
FIG. 3 shows a schematic representation of the cross section along line I-I' of FIG. 2.

FIG. 3 shows the cross section of FIG. 2 at line I-I'. In this cross section the radiant screen 30 is straight and is at a distance from the burner plate 32.

Figure 4:
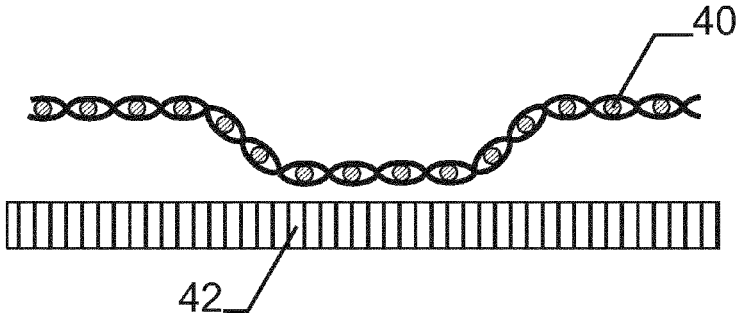
FIG. 4 shows a schematic representation of the cross section along line II-II' of FIG. 2.

FIG. 4 shows the cross section of FIG. 2 at line II-II'. In this cross section the radiant screen 40 is embossed creating at the embossment a lower distance to the burner plate 42.

Figure 5:
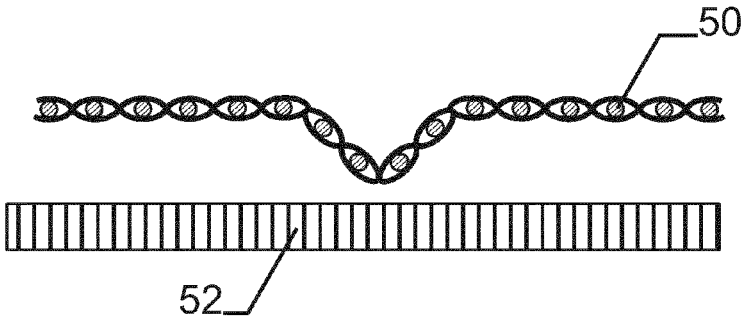
FIG. 5 shows a schematic representation of the cross section along line III-III' of FIG. 2.

FIG. 5 shows the cross section of FIG. 2 at line III-III'. In this cross section the radiant screen 50 is embossed creating at the embossment a lower distance to the burner plate 52.

Figure 6:
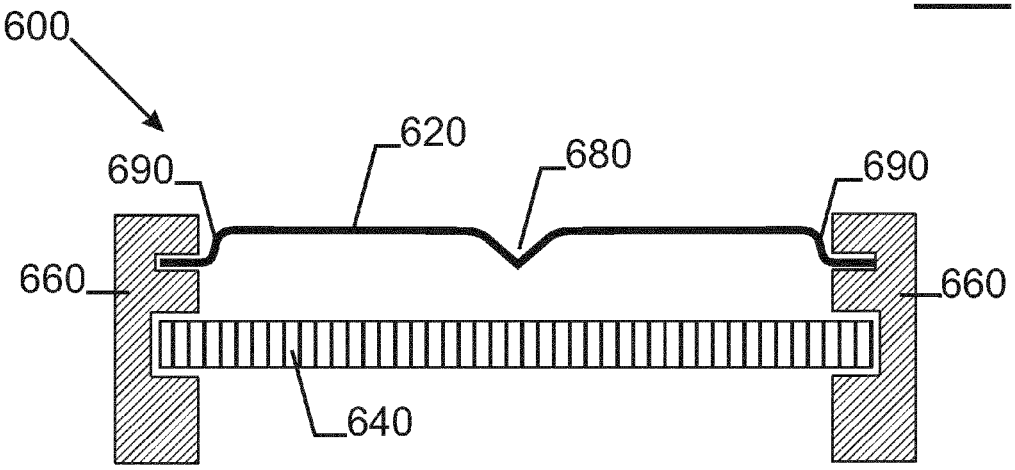
FIG. 6 shows a schematic representation of an alternative embodiment of the invention.

FIG. 6 shows an alternative embodiment of a gas fired infrared radiation emitter 600 according to the invention. Radiant screen 620 and burner plate 640 are fixed in a housing 660. Radiant screen 620 is embossed in the middle 680 and bent at the fixations 690 with the housing 660.

Figure 7:
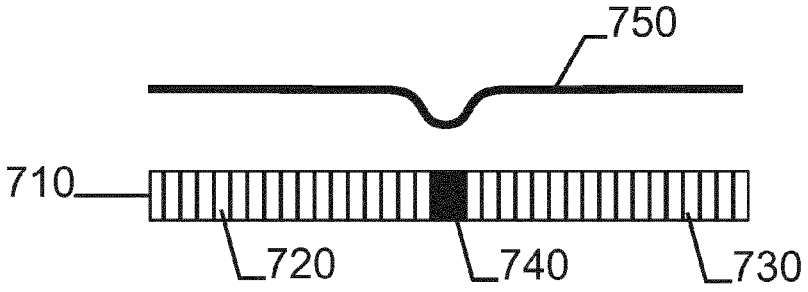
FIG. 7 shows a schematic representation of an embodiment of the invention comprising two tiles in the burner surface.

FIG. 7 shows an embodiment of the invention in which the burner plate 710 comprises two perforated tiles 720 and 730. The two perforated tiles 720 and 730 are joined side by side with a refractory jointing compound or tile cement 740. The radiant screen 750 is embossed at the location of the joint 740 between the two tiles 720 and 730.

Figure 8:
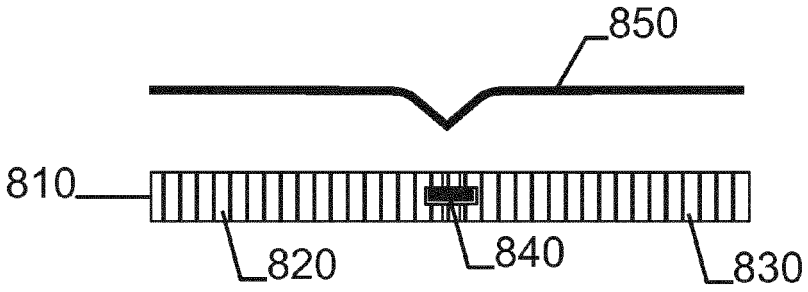
FIG. 8 shows a schematic representation of an alternative embodiment of the invention comprising two tiles in the burner surface.

FIG. 8 shows an embodiment of the invention in which the burner plate 810 comprises two perforated tiles 820 and 830. Two perforated tiles 820 and 830 are joined side by side via an insert 840. The radiant screen 850 is embossed at the location of the joint 840 between the two tiles 820 and 830. The insert 840 creates a flexible joint between the two tiles 820 and 830.

Figure 9:
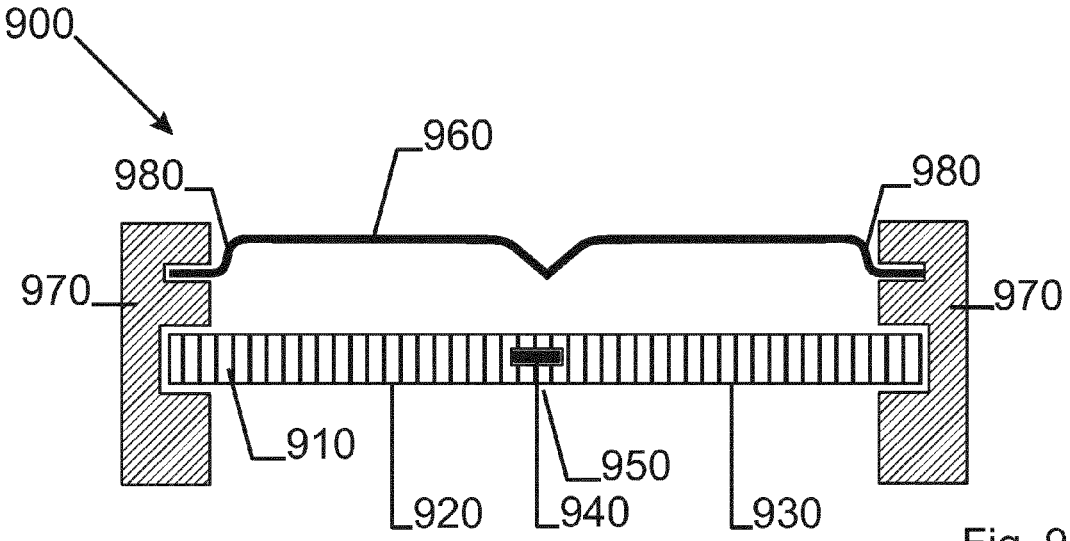
FIG. 9 shows a schematic representation of yet an alternative embodiment of the invention comprising two tiles in the burner surface.

FIG. 9 shows an alternative embodiment of a gas fired infrared radiation emitter 900 according to the invention. Burner plate 910 comprises two perforated tiles 920 and 930. The two perforated tiles 920 and 930 are joined side by side via an insert 940 forming a junction 950. Radiant screen 960 and burner plate 910 are fixed in a housing 970. Radiant screen 960 is embossed above the junction 950 between the two perforated tiles 920 and 930. The radiant screen 960 is bent at the fixations 980 with housing 970.

Figure 10:
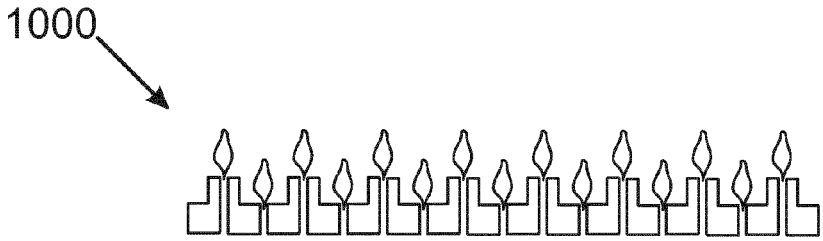
FIG. 10 shows a schematic representation of a burner plate with two different levels of combustion surface.

FIG. 10 shows a schematic representation of a burner plate 1000 with two different levels of the combustion surface.

Figure 11:
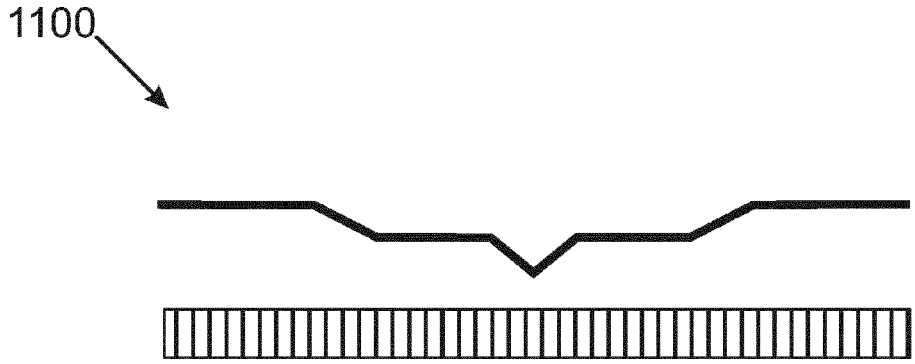
FIG. 11 shows a schematic representation of an alternative cross section of the embossment along line III-IIII' of FIG. 2.

FIG. 11 shows a schematic representation of an alternative cross section of the embossment along line III-III' of FIG. 2, in which the cross section of the embossment is shown as 1100.

Figure 12:
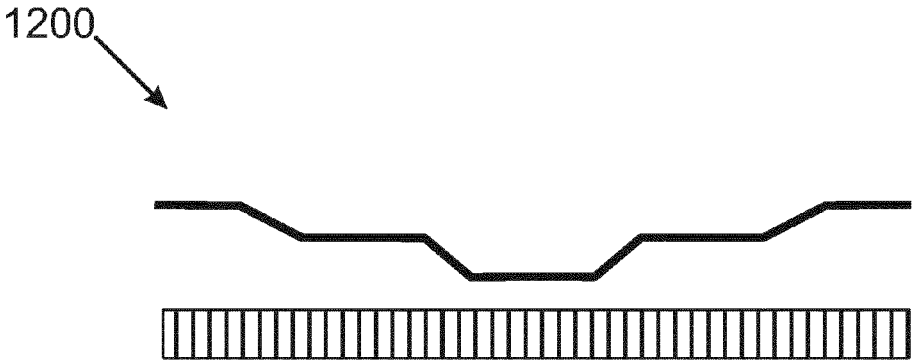
FIG. 12 shows a schematic representation of a yet another alternative cross section of the embossment along line III-III' of FIG. 2.

FIG. 12 shows a schematic representation of a yet another alternative cross section of the embossment along line III-III' of FIG. 2, in which the cross section of the embossment is shown as 1200.

Figure 13:
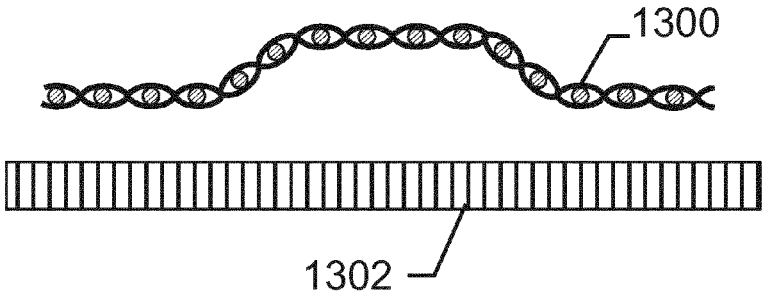
FIG. 13 shows a schematic representation of another embodiment of the invention.

FIG. 13 shows the cross section of another embodiment of the invention. In this cross section the radiant screen 1300 is embossed at a central zone of the burner plate creating at the embossment a larger distance to the burner plate 1302.

Figure 14:
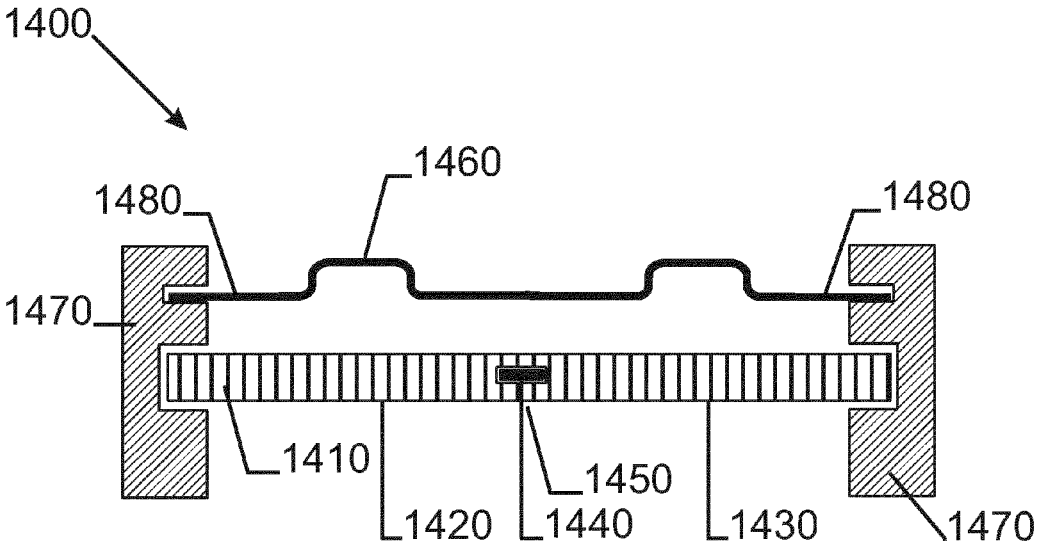
FIG. 14 shows a schematic representation of another embodiment of the invention.

FIG. 14 shows yet an alternative embodiment of a gas fired infrared radiation emitter 1400 according to the invention. Burner plate 1410 comprises two perforated tiles 1420 and 1430. The two perforated tiles 1420 and 1430 are joined side by side via an insert 1440 forming a junction 1450. Radiant screen 1460 and burner plate 1410 are fixed in a housing 1470. Radiant screen 1460 is embossed in the central zones of the perforated tiles 1420 and 1430, providing in the embossments larger distances to the burner plate. The radiant screen 1460 is fixed at 1480 into housing 1470.

In one embodiment, the embossment in the radiant screen ends along its longest length at a distance in the range of 4 to 30 mm from the side of the radiant screen. In a more preferred embodiment, the embossment in the radiant screen ends along its longest length at a distance in the range of 5 to 20 mm from the side of the radiant screen. In an even more preferred embodiment, the embossment in the radiant screen ends along its longest length at a distance in the range of 5 to 10 mm from the side of the radiant screen.

In one embodiment, the embossment is in a V-shape, the legs of the "V" have an included angle between 50 and 130 degrees. In a preferred embodiment, the legs of the "V" have an included angle between 60 and 120 degrees. In a more preferred embodiment, the legs of the "V" have an included angle between 75 and 105 degrees.

In one embodiment of the invention the distance of the flat portion of the radiant screen to the combustion surface is within the range of 5-20 mm. In a more preferred embodiment, the distance of the flat portion of the radiant screen to the combustion surface is within the range of 7-17 mm. In another embodiment of the invention, the distance of the flat portion of the radiant screen to the combustion surface is within the range of 10-15 mm.

In one embodiment of the invention, the depth of an embossment with closer distance to the flat portion of the radiant screen is at its deepest point in the range of 6 to 15 mm. In a preferred embodiment, the depth of an embossment with closer distance to the flat portion of the radiant screen is at its deepest point in the range of 6 to 12 mm. In a more preferred embodiment, the depth of an embossment with closer distance to the flat portion of the radiant screen is at its deepest point in the range of 7 to 10 mm.

In one embodiment of the invention, the gap between the deepest point of an embossment with closer distance and the combustion surface is in the range of 2-8 mm. In a preferred embodiment, the gap between the deepest point of an embossment with closer distance and the combustion surface is in the range of 2-5 mm.

The invention claimed is:

1. A gas fired infrared radiation emitter comprising a burner plate, said burner plate acting as combustion surface, and a radiant screen positioned at the combustion side of said burner plate, wherein said radiant screen is embossed providing at the embossment or embossments different distances between said burner plate and said radiant screen compared to the distance between said burner plate and said radiant screen at the non-embossed part of said radiant screen, the burner plate comprises a ceramic plate, and the radiant screen is a metal grid or a woven wire mesh.

2. The gas fired infrared radiation emitter of claim 1, wherein said different distances are closer distances.

3. The gas fired infrared radiation emitter of claim 1, wherein said radiant screen comprises a number of embossments and said different distances are closer distances at some of the embossments and larger distances at some of the other embossments.

4. The gas fired radiation emitter of claim 1, wherein at at least some of the embossments the distances between said burner plate and said radiant screen are larger than the distance between said burner plate and said radiant screen at the non-embossed part of said radiant screen.

5. The gas fired infrared radiation emitter of claim 1, wherein the burner plate comprises more than one ceramic plate.

6. The gas fired infrared radiation emitter of claim 1, wherein the burner plate comprises at least two perforated tiles.

7. The gas fired infrared radiation emitter of claim 6, in which the radiant screen is embossed at at least one junction between two perforated tiles of the burner plate.

8. The gas fired infrared radiation emitter of claim 7, in which the radiant screen is embossed at all the junctions between perforated tiles of the burner plate.

9. The gas fired infrared radiation emitter of claim 1, wherein the burner plate comprises two perforated tiles positioned side by side, and wherein the radiant screen is embossed at the junction between the two perforated tiles.

10. The gas fired infrared radiation emitter of claim 1, wherein the burner plate has multiple levels of combustion surface spread over the surface of the burner plate.

11. The gas fired infrared radiation emitter of claim 1, wherein the embossment has a V-shape or a U-shape.

12. The gas fired infrared radiation emitter of claim 1, wherein the radiant screen is bent at at least one of the end sides of the radiant screen.

13. The gas fired infrared radiation emitter of claim 1, wherein there is an air gap between the burner plate and the radiant screen over the full surface of the burner plate.

* * * * *